US006528744B2

(12) United States Patent
Bremner et al.

(10) Patent No.: US 6,528,744 B2
(45) Date of Patent: Mar. 4, 2003

(54) COVER FOR VEHICLE CONTROL SWITCH

(75) Inventors: Ronald Dean Bremner, Cedar Falls, IA (US); Niels Dybro, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 57 days.

(21) Appl. No.: 09/845,547

(22) Filed: Apr. 30, 2001

(65) Prior Publication Data

US 2002/0020614 A1 Feb. 21, 2002

Related U.S. Application Data

(60) Provisional application No. 60/211,982, filed on Jun. 16, 2000.

(51) Int. Cl.[7] ..... H01H 9/20
(52) U.S. Cl. ..... 200/43.16; 200/334
(58) Field of Search ..... 200/43.17, 43.16, 200/333, 334

(56) References Cited

U.S. PATENT DOCUMENTS

| | | | | |
|---|---|---|---|---|
| 1,247,996 A | | 11/1917 | Parker | |
| 2,163,962 A | | 6/1939 | Pomernacki | |
| 2,348,393 A | * | 5/1944 | Krieger | 200/334 |
| 3,204,807 A | | 9/1965 | Ramsing | |
| 3,358,294 A | | 12/1967 | Nolan et al. | |
| 4,240,523 A | | 12/1980 | Nestor et al. | |
| 4,910,365 A | | 3/1990 | Kuo | |
| 4,971,092 A | | 11/1990 | Parry et al. | |
| 5,161,679 A | * | 11/1992 | Russo | 200/43.17 |
| 5,290,979 A | | 3/1994 | Grass | |
| 5,362,933 A | | 11/1994 | Kutsche et al. | |
| 5,486,660 A | | 1/1996 | Fasano | |
| 5,487,493 A | | 1/1996 | McNabb | |
| 5,775,481 A | | 7/1998 | Lyke | |
| 5,874,698 A | | 2/1999 | Collis | 200/43.16 X |

FOREIGN PATENT DOCUMENTS

| | | | | |
|---|---|---|---|---|
| GB | 2242571 A | * | 10/1991 | 200/43.16 |

* cited by examiner

*Primary Examiner*—Renee Luebke

(57) ABSTRACT

A cover is provided for a control switch in a vehicle that is movable between open and closed positions. In the cover open position, the switch paddle is freely accessible. In the cover closed position, the switch paddle is partially covered to limit access to the paddle and alert the operator to thereby avoid unintended actuation of the switch. In the closed position, the paddle is still accessible if needed to actuate the switch in an emergency without first opening the cover.

17 Claims, 3 Drawing Sheets

COVER FOR VEHICLE CONTROL SWITCH

This application claims the benefit of U.S. Provisional Application No. 60/211,982, filed Jun. 16, 2000.

BACKGROUND OF THE INVENTION

1. Field of the Invention

The present invention relates to off road vehicles such as agricultural or construction tractors in which the operator has one or more switches that are used to control various machine functions such as, but not limited to, controlling the hydraulic system. Often these switches are located on the armrest of the operator's seat for easy access by the operator.

2. Description of Related Art

In a work vehicle, such as a tractor, an array of identical switches may be provided to operate different portions of the hydraulic system. These switches may be actuated to turn on or off various functions during the operation of the machine. Inadvertent deactivation of a switch or inadvertent activation of a.switch by improper finger placement can result in an undesired machine function and a loss of productivity. For example, when planting with an air seeder, one switch controls the seeder blower fan motor. Actuation of the switch to interrupt the air distribution while planting has time consuming consequences. On the other hand, an adjacent or nearby switch actuates the hydraulics to raise or lower the implement during headland turns and thus must be available for activation.

To avoid inadvertent actuation of a switch, it is been known to provide plugs that can be inserted on a switch to restrict movement of the switch. Unfortunately, when it is necessary to actuate the switch, the plug must first be removed and the switch actuated. This can be a time consuming process and undesirable in an emergency situation.

SUMMARY OF THE INVENTION

The present invention seeks to overcome the disadvantages in the prior art by providing individual covers for each switch within the housing in which the switch is mounted. Each cover can be moved to an open position providing free access to its respective switch. Alternatively, the cover can be rotated to a closed position in which the switch is covered in such a way as to prevent inadvertent actuation of the switch. However, in the preferred embodiment, when the cover is in the closed position, access is still provided to the switch to move the switch to deactivate a machine function. Thus, any function can be stopped without first uncovering the switch.

Each cover has a hook like detent feature at one end that engages with a portion of the armrest housing to secure the cover in the closed position to avoid movement of the cover by excessive vibration, etc. One or more of the covers can be provided with a raised or recessed portion to provide a tactile feedback to the operator as to which switch the cover is associated so that the operator can properly place his or her fingers on the switch covers by feel rather than by sight.

DESCRIPTION OF THE PREFERRED EMBODIMENT

Figure 1:
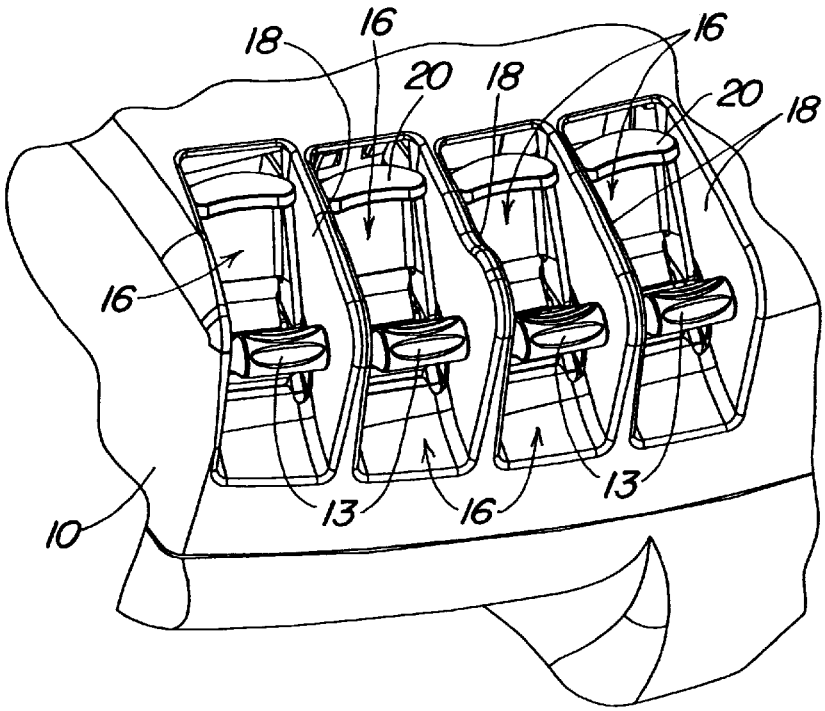
FIG. 1 is a perspective view of a vehicle armrest showing switches with the covers of the present invention in open positions in which the switches are uncovered.

FIG. 1 shows the armrest 10 of a working vehicle that has an array of paddle switches and covers according to the present invention. The armrest 10 includes four paddle switches 12 generally identical to one another. The paddle switches 12 are located toward the forward end of the armrest and have paddles 13 movable by an operator in opposite directions as shown by the arrow 14 in FIG. 3. The paddles 13 are located in recesses 16 in the armrest housing such that they are generally within the armrest housing rather than protruding therefrom. The recesses are separated by divider walls 18. A cover 20 according to the present invention is associated with each switch 12. While the invention is shown with switches in an armrest control, it will be appreciated that the switches can be located elsewhere in a vehicle cab.

Figure 2:
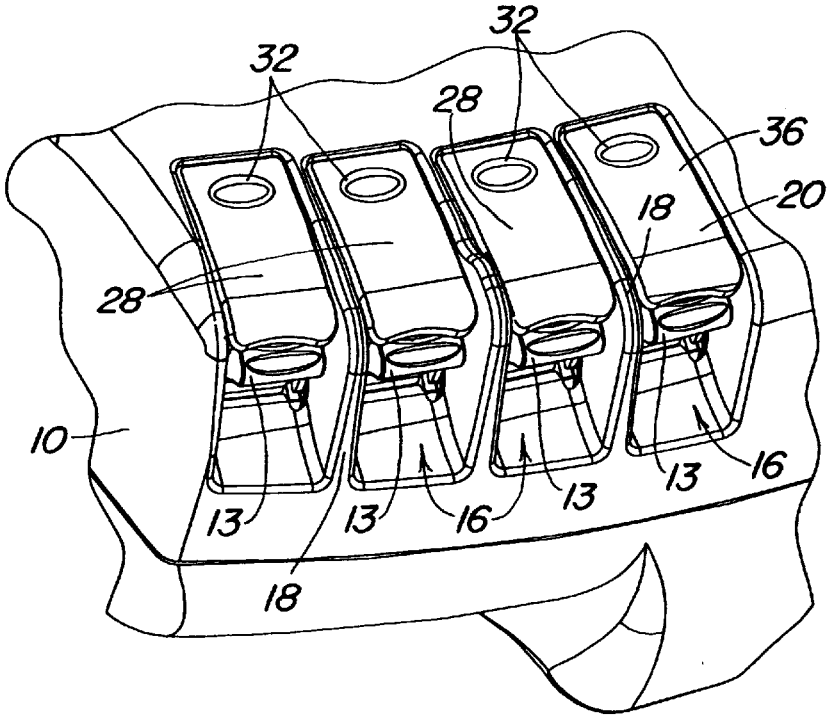
FIG. 2 is similar to FIG. 1 showing the covers in the closed position.
Figure 3:
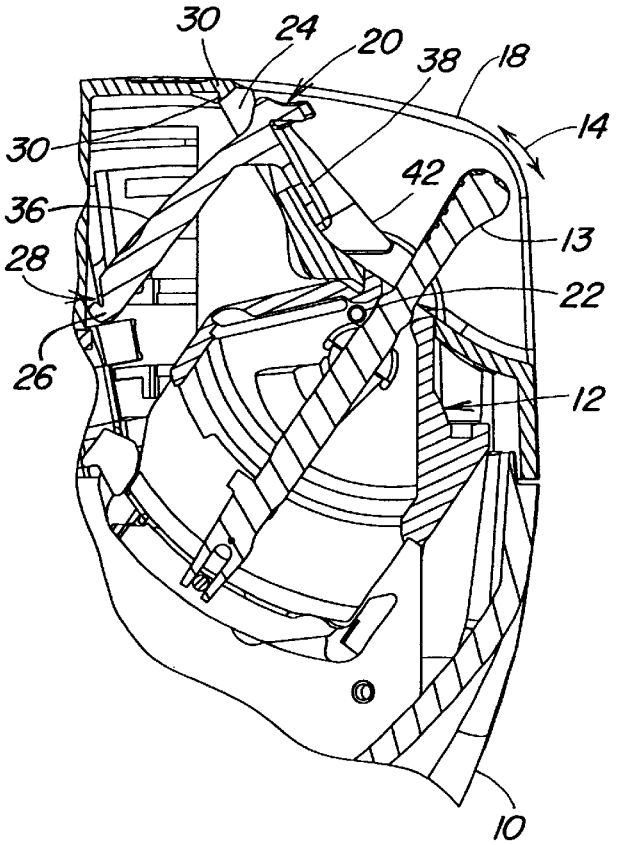
FIG. 3 is a sectional view showing one switch and the cover in the open position.
Figure 4:
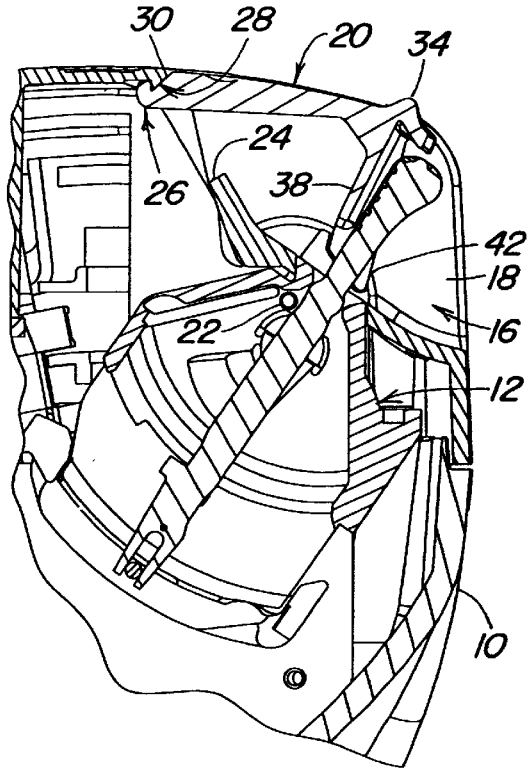
FIG. 4 is a sectional view like FIG. 3 showing the switch with the cover in the closed position.
Figure 5:
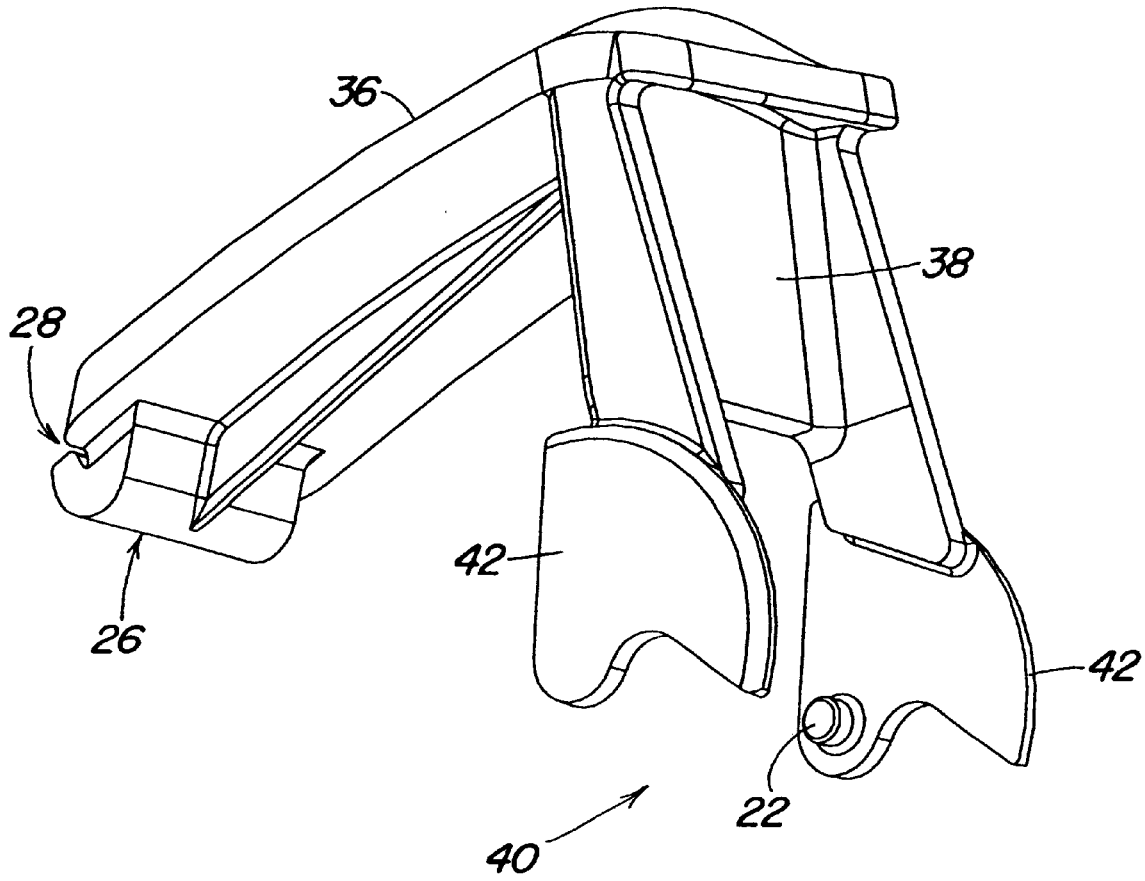
FIG. 5 is a perspective view of a cover according to the present invention.

The covers 20 are mounted to the armrest housing for rotation about the pivot post 22 shown in FIGS. 3–5 and further described in connection with FIG. 5. In FIG. 2, the covers 20 are shown rotated to closed positions in which they cover the paddles 13 by closing the recesses 16 from above. The front of each recess 16 remains open so that the paddles can be pushed rearward to rotate the paddles counter clockwise as viewed in FIG. 4 so that a machine function can be turned off quickly without first moving the cover to its open position. Each cover 20 extends rearward through an opening 24 in the armrest housing as shown in FIG. 3. The rear portion 26 of the cover is formed with a recess 28 that receives a hook 30 in the armrest housing to form a snap fit of the cover in the closed position covering the paddle 13. This provides a positive engagement of the cover to prevent unintended movement of the cover to the open position by vibration or inadvertent touching by the operator.

To facilitate moving the cover to the open position, the top of the cover is formed with a recess 32 to apply a downward force to disengage the hook 30 and easily return the cover to the open position. In addition, one or more of the covers can include a raised protrusion 34 toward the front of the cover that provides a tactile feedback to the operator.

In a preferred embodiment, the armrest housing and the covers 20 are molded plastic components but can be made of other materials as well.

In a preferred embodiment, the switches 12 are center biased with the paddles in the position shown in the Figures and movable in opposite directions as shown by the arrow 14 of FIG. 3. In operation during air seeding, one switch is used to activate the blower fan, another switch activates the seed meters and a third switch raises and lowers the seeder. The fan and seed meters are turned on and the seeder is lowered into the ground. The operator will close the cover 20 on the switch that controls the blower fan. When the end of the row is reached, the other two switches are pulled rearward to raise the seeder and stop the seed meter. It is critical that the blower fan not be turned off. Turning off the blower fan can cause the seeder to plug and require extensive down time to clean. Thus, the cover 20 on the fan switch is closed to prevent inadvertently turning off the fan. However, the paddle is open on the front and, in the event of an emergency requiring the operator to turn off the blower fan, the paddle can be accessed and the switch turned off without first moving the cover.

The cover has a top portion 36 and a front leg 38 that extends downward to a forked end 40 having side arms 42 on either side of the respective paddle. The pivot posts 22 are integrally formed in the side arms 42. The front leg 38 is positioned adjacent the paddle 13 of the respective switch as shown in FIG. 4 so that the cover moves to the open position in the event the switch must be turned off suddenly without first moving the cover to the open position.

The cover of the present invention operates to prevent unintended actuation of the switch but is not a lock out that prevents actuation. The switch can still be accessed and turned off even when covered. The cover, when closed, alerts the operator that the switch is not to be actuated in the normal course of operation.

The advantages of the cover of the present invention is that it can be used to eliminate inadvertent actuation of the switches, provide positive placement of the operator's fingertips, includes a detent mechanism to hold the cover in place to prevent movement of the cover due to vibration, individual covers are provided for each switch, and each switch can be quickly moved to an off position without first moving the cover to the open position.

What is claimed is:

1. A vehicle control switch and cover assembly comprising:

a housing;

a switch mounted in the housing and having a paddle member movable by an operator to one of multiple positions to control a vehicle function; and a cover movably mounted to the housing for movement between open and closed positions, the cover in the open position enabling unrestrained access to the paddle and the cover in the closed position partially blocking access to the paddle to prevent unintended movement of the paddle by the operator;

wherein the switch paddle is disposed in a recess in the housing and the cover in the closed position partially covers the recess and does not substantially extend from the recess.

2. The vehicle control switch and cover assembly as defined by claim 1 wherein the paddle is movable in opposite directions from a center biased position.

3. The vehicle control switch and cover assembly as defined by claim 2 wherein the cover in the closed position covers the paddle from one direction.

4. The vehicle control switch and cover assembly as defined by claim 2 wherein the switch and paddle are located at the upper front corner of the housing and the paddle is accessible from above to move the paddle forward and accessible from the front to move the paddle rearward.

5. The vehicle control switch and cover assembly as defined by claim 4 wherein the cover when in the closed position covers the paddle from above.

6. The vehicle control switch and cover assembly as defined by claim 2 wherein the cover is rotatably mounted to the housing to move between the open and closed positions.

7. The vehicle control switch and cover assembly as defined by claim 1 wherein the cover has a leg portion adjacent the paddle when the cover is in the closed position wherein movement of the paddle in one direction also moves the cover to the open position.

8. The vehicle control switch and cover assembly as defined by claim 1 further comprising a snap engagement device operable between the housing and the cover to retain the cover in the closed position.

9. A vehicle control switch and cover assembly comprising:

a housing;

a switch mounted in the housing and having a paddle member biased to a center position and movable by an operator in opposite directions to control a vehicle function; and, a cover movably mounted to the housing for movement between open and closed positions, the cover in the open position enabling unrestrained access to the paddle and the cover in the closed position partially blocking access to the paddle to prevent unintended movement of the paddle by the operator;

wherein the switch paddle is disposed in a recess in the housing and the cover in the closed position partially covers the recess and does not substantially extend from the recess.

10. The vehicle control switch and cover assembly as defined by claim 9 wherein the switch and paddle are located at the upper front corner of the housing and the paddle is accessible from above to move the paddle forward and accessible from the front to move the paddle rearward.

11. The vehicle control switch and cover assembly as defined by claim 10 wherein the cover when in the closed position covers the paddle from above.

12. The vehicle control switch and cover assembly as defined by claim 11 wherein the cover has leg portion adjacent the paddle when the cover is in the closed position wherein movement of the paddle rearward also moves the cover to the open position.

13. The vehicle control switch and cover assembly as defined by claim 9 wherein the cover is rotatably mounted to the housing to move between the open and closed positions.

14. The vehicle control switch and cover assembly as defined by claim 9 wherein the cover has a leg portion adjacent the paddle when the cover is in the closed position wherein movement of the paddle in one direction also moves the cover to the open position.

15. The vehicle control switch and cover assembly as defined by claim 9 further comprising a snap engagement device operable between the housing and the cover to retain the cover in the closed position.

16. A vehicle control switch and cover assembly comprising:

a housing;

a plurality of switches mounted in the housing and each having a paddle member, the switches being center biased switches in which the paddles are movable forward and rearward by a vehicle operator to control a vehicle function; and, a cover movably mounted to the housing for each switch for movement between open and closed positions, the cover in the open position enabling unrestrained access to the paddle and the cover in the closed position partially covering a respective paddle to alert the operator and thereby prevent unintended movement of the paddle by the operator;

wherein the paddles are located in a recess in the housing and the cover closes the recess from above while leaving the paddle open from the front.

17. The vehicle control switch and cover assembly as defined by claim 16 wherein each cover covers a paddle from above and prevents unintended movement of the paddle rearward.

* * * * *